US006250942B1

(12) United States Patent
Lemke et al.

(10) Patent No.: US 6,250,942 B1
(45) Date of Patent: Jun. 26, 2001

(54) ELECTRICAL CONNECTOR WITH COMBINED SHIELD AND LATCH

(75) Inventors: Timothy A. Lemke, Dillsburg; Timothy W. Houtz, Etters, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/385,146

(22) Filed: Aug. 30, 1999

(51) Int. Cl.[7] ..... H01R 13/627
(52) U.S. Cl. ..... 439/352
(58) Field of Search ..... 439/352, 353, 439/607, 357, 358, 347, 610

(56) References Cited

U.S. PATENT DOCUMENTS 3,871,735 3/1975 Herrmann, Jr. ..... 339/177 R
4,337,989 7/1982 Asick et al. ..... 339/143 R
5,021,002 6/1991 Noschese ..... 439/352
5,611,711 3/1997 Okada et al. ..... 439/608
5,660,558 8/1997 Osanai et al. ..... 439/353

*Primary Examiner*—Tulsidas Patel
*Assistant Examiner*—Javaid Nasri
(74) *Attorney, Agent, or Firm*—Perman & Green, LLP

(57) ABSTRACT

An electrical connector comprising a housing, an electrical contact in the housing, and a shield connected to the housing. The shield comprises a latching section with a latch, a deflection control section, and a first torsionally deflectable beam extending laterally from the latching section at a location between the latch and the deflection control section. The beam connects the latching section to the rest of the shield.

18 Claims, 3 Drawing Sheets

ELECTRICAL CONNECTOR WITH COMBINED SHIELD AND LATCH

BACKGROUND OF THE INVENTION

1. Field of the Invention

The present invention relates to electrical connectors and, more particularly, to an electrical connector having a combined shield and latch.

2. Brief Description of Earlier Developments

U.S. Pat. No. 5,611,711 discloses an electrical connector with a shield jacket. U.S. Pat. No. 5,660,558 discloses an electrical connector having a shield with integral latch arms. U.S. Pat. No. 5,021,002 discloses an electrical connector with a movable outer hood and a snap-lock latch. Most cable assemblies that are used to interconnect units of electronic equipment are required to perform a number of functions in addition to the normal function of providing an electrical pathway between two pieces of equipment. The cable connectors must be rugged and resistant to damage by normal use. They must be capable of being mechanically secured to the equipment so that they are not easily dislodged during use. The electromagnetic integrity of the electronic systems needs to be maintained between the electronic systems so that undesirable electronic signals are not emitted from the system. The multiple functions required of these connectors tends to make "external" cable assemblies high in cost, since they typically require a number of component parts to perform the various mechanical and electrical functions such as signal transmission, mechanical latching and electromagnetic shielding. All of the various pieces of the system must also fit together properly for reliable function. Therefore it is desirable to integrate some of these functions to lower the number of components and their costs and to improve reliability. This is particularly true in miniaturized systems where the requirements for precision and accuracy are great. There is a need for an electrical connector having integration of shielding and latching functions for a lower manufacturing cost and higher potential reliability than prior art designs.

SUMMARY OF THE INVENTION

In accordance with one embodiment of the present invention, an electrical connector is provided comprising a housing, an electrical contact connected to the housing, and an electromagnetic grounding shield connected to the housing. The shield comprises a latching section with a latch, a deflection control section, and a first torsionally deflectable beam extending laterally from the latching section at a location between the latch and the deflection control section. The bean connects the latching section to the rest of the shield.

In accordance with another embodiment of the present invention, an electrical connector is provided comprising a housing, at least one electrical contact connected to the housing, and an electromagnetic grounding shield. The housing comprises a base and a cover movably connected to the base. The cover comprises a latch deflector. The electromagnetic grounding shield is connected to the housing. The shield comprises a front latch and a deflection control section. The deflection control section is located beneath the latch deflector. The front latch and latch deflector are movable between up and down positions in reverse unison. The latch deflector is movable to depress the deflection control section which raises the latch.

In accordance with one method of the present invention, a method of manufacturing an electrical connector is provided comprising steps of connecting an electromagnetic shield to a base of a housing of the connector, the shield comprising an integral latch and an integral latch deflection control; and connecting a cover to the base over the shield, the cover comprising a latch deflector located at the latch deflection control, wherein the cover is movable relative to the base between a first position and a second position, wherein when the cover is moved from the first position to the second position the latch deflector moves the latch deflection control in an inward direction causing the latch to deflect in an outward direction.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
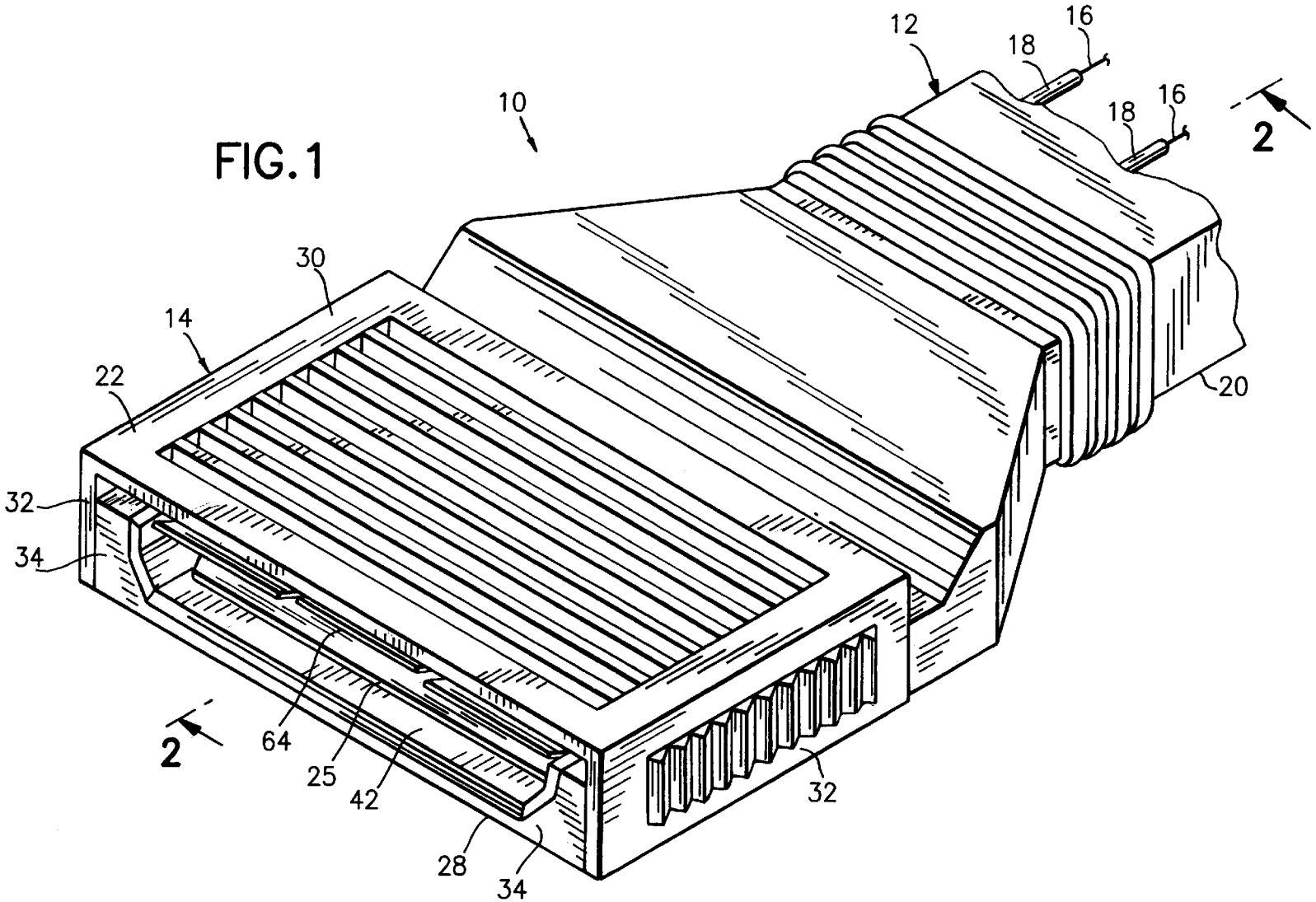
FIG. 1 is perspective view of a portion of a cable assembly having an electrical connector incorporating features of the present invention.

Referring to FIG. 1, there is shown a partial perspective view of a cable assembly 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The cable assembly 10 generally comprises a cable 12 and an electrical connector 14 connected to one end of the cable 12. In alternate embodiments the connector 14 could be provided separate from the cable 12. The opposite end of the cable 12 could be connected to another electrical connector (not shown) or connected directly to an electronic component. The cable 12 preferably comprises a plurality of electrical conductors 16 with individual insulative covers 18 and a main common cover 20. However, any suitable type of cable could be provided. The cable 12 could also include any suitable number or type of conductors 16. Further, cable 12 could include, for example, conductive braiding (not shown) to which a suitable portion of connector 14 (e.g.: conductive base 28 or shield 26) connects using known techniques.

Figure 2:
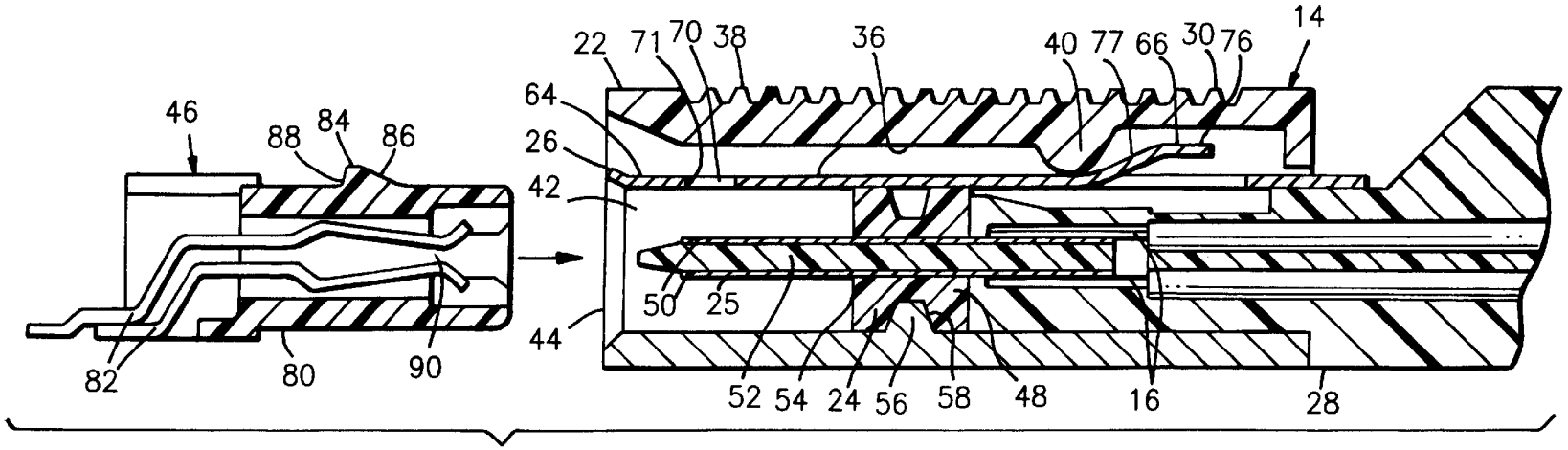
FIG. 2 is a cross-sectional view of the connector shown in FIG. 1 shown with a mating electrical connector.
Figure 3:
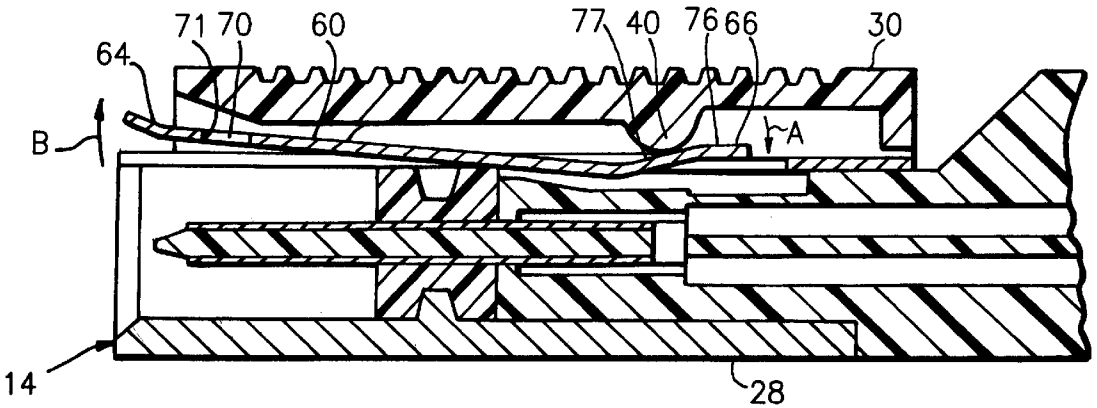
FIG. 3 is a cross-sectional view of the connector as shown in FIG. 2 with the cover moved to a rearward position.

Referring also to FIG. 2, the connector 14 generally comprises a housing 22, a contact sub-assembly 24, and an electromagnetic grounding shield 26. The housing 22 generally comprises a base 28 and a cover 30. The base 28 is preferably comprised of a suitable conductive material such as metal or plastic with a metalized surface. In a preferred embodiment the base 28 has a general "U" shaped profile with an open top. The cover 30 is preferably comprised of an insulative material such as molded plastic, but any suitable material could be used. The cover 30 is also preferably provided with a general "U" shaped profile, but with an open bottom. The side walls 32 of the cover extend along the extension side of the side walls 34 of the base 28 and connect to the cover and base to each other. The cover 30 is slidingly connected to the base 28 between a forward position shown in FIGS. 1 and 2 and a rearward position as shown in FIG. 3 for latching/unlatching purposes. The underside 36 of the top section 38 of the cover 30 includes a protrusion 40. The protrusion 40 projects inwardly and forms a latch deflector. The housing 22, formed by the base 28 and cover 30, forms an enclosure for the contact sub-assembly 24 and the shield 26. The base 28 and cover 30 define a receiving area 42 therebetween that extends from a front end 44 for receiving a portion of a mating electrical connector 46. The front end of the contact sub-assembly 24 extends into the receiving area 42. In alternate embodiments any suitable type of housing could be provided and may comprise more components than merely the base and cover mentioned above. In addition, any suitable type of base and cover could be used. The housing could also be a one-piece member.

The contact sub-assembly 24 generally comprises an insert 48 and a plurality of electrical contacts 50 mounted to the insert 48. The insert 48 preferably includes a center contact support 52 projecting from a base 54. Insert 48 is preferably unitary and comprised of dielectric material, such as molded plastic. However, any suitable insert could be provided. The contacts 50 are preferably comprised of a suitable conductive material such as a copper alloy which has been stamped and formed from a sheet into the individual contacts 50. The contacts 50 are preferably inserted through openings in insert 48 and extend along the center contact support 52. The ends of the conductors 16 are attached to the opposite ends of respective ones of the contacts 50 extending from the other side of insert 48, such as by soldering, welding or any other suitable attachment technique. The base 54 of the insert 48 can, for example, fixedly attach to the base 28 of the housing 22 with rail 56 located in groove 58. However, other attachment methods, such as latches, could be used. In addition, insert 48 could be overmolded about contacts 50.

Figure 4:
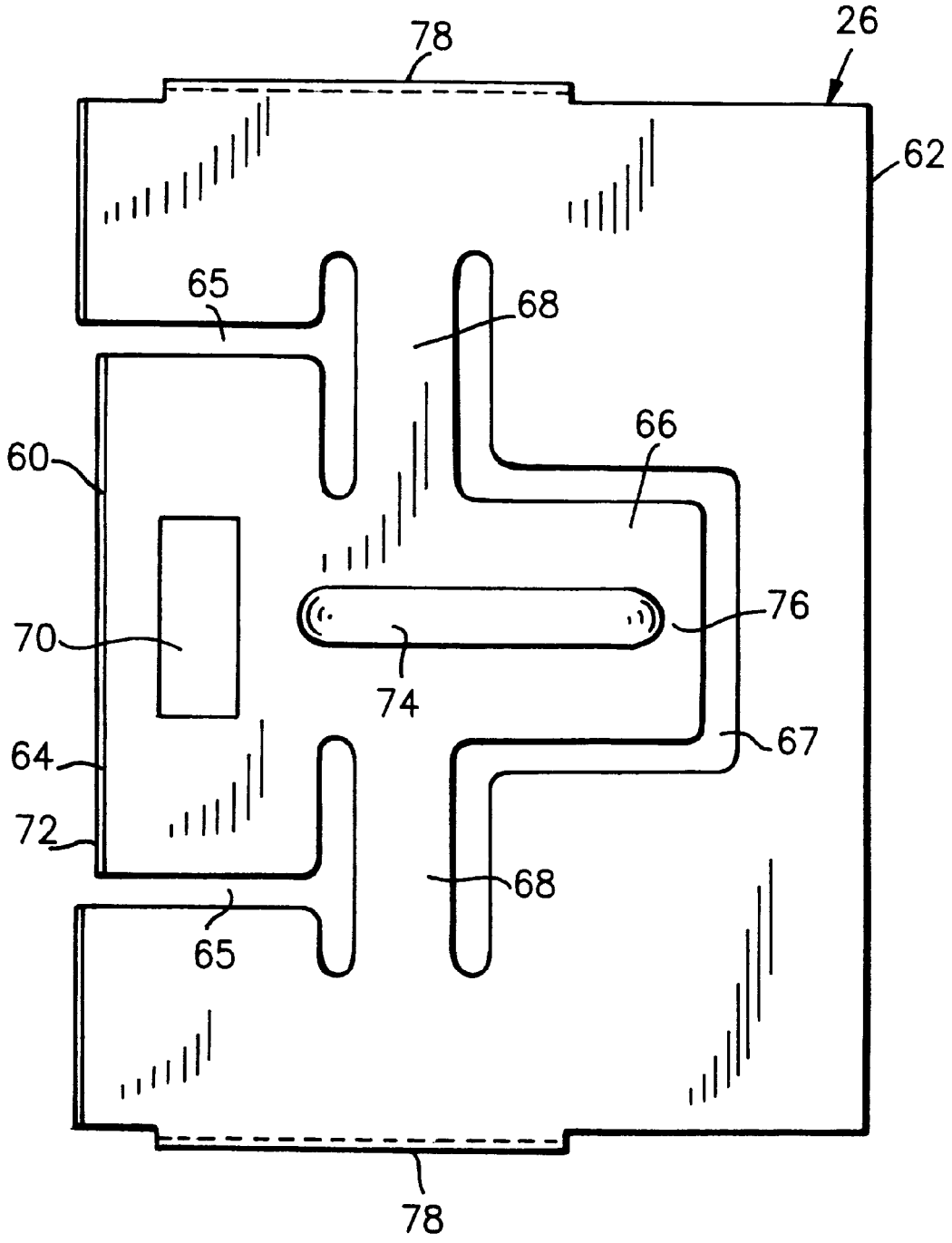
FIG. 4 is a top plan view of the shield used in the connector shown in FIG. 1.

Referring also to FIG. 4, a top plan view of the shield 26 is shown. The shield 26 is preferably one-piece and made from a suitable sheet of conductive material which has been stamped and formed into the shape shown. However, in an alternate embodiment the shield could be comprised of multiple pieces, or any suitable type of shield could be provided. The shield 26 generally comprises a generally movable latching section 60 and a substantially stationary section 62. The latching section 60 generally comprises a latch 64 and a deflection control section 66. The shield 26 also has connecting sections 68 which connect the latching section 60 to the substantially stationary section 62. The latch 64 is formed by removing material of the shield from areas 65, such as during stamping. The latch 64 generally comprises a latch hole 70 through the shield 26. The latch 64 is located in the front of the shield and extends in a forward general cantilevered fashion from the area where the connecting sections 68 are connected to the latching section 60. Preferably, the front edge 72 of the latch 64 is sloped upward to provide a lead-in surface. The deflection control section 66 also extends in a general cantilevered fashion from the area where the connecting sections 68 are connected to the latching section 60, but in a rearward direction; generally opposite to the direction of the latch 64. The deflection control section 66 is formed by removing material of the shield from area 67, such as during stamping. As seen best in FIG. 2, the rear section 76 of deflection control section 66 also extends upwardly. A deformation 74 stamped into shield 26 extends between latching section 60 and deflection control section 66. The deformation 74 functions as a stiffener between the latch 64 and the deflection control section 66. The substantially stationary section 62 has sides 78. The sides 78 can extend downwardly and may latch onto the side walls 34 of the base 28. The shield 26 can, thus, make an electrical connection with the base 28 to substantially surround the contact sub-assembly 24 and receiving area 42 with an electromagnetic shield. The bottom side of the shield 26, at the connecting sections 68, rest against the top side of the mounting support 54 of the contact sub-assembly frame 48.

With the cover 30 in the forward position shown in FIG. 2, the latch 64 is in a down latching position and the deflection control section 66 is in an up position. The inward protrusion 40 from the cover 30 is located in front of the ramp 77 leading up to the elevated rear section 76 of the deflection control section 66. This allows latch 64 to move resiliently or to deflect upwardly as the mating connector 46 is inserted into the receiving area 42.

The mating connector 46 generally comprises a housing 80 and electrical contacts 82. The housing 80 includes a latch structure 84 on its top side. The latch structure 84 includes a front ramp surface 86 and a rear latch surface 88. The housing 80 also forms a receiving area 90 with the contacts 82 for receiving the front portion 25 of the contact sub-assembly 24. When the mating connector 46 is inserted into the receiving area 42, the contacts 82 make electrical connection with the contacts 50. The latch structure 84 also makes a latching engagement with the latch 64. The front ramp surface 86 wedges the latch 64 upward until the latch structure 84 comes into registry with the hole 70. The connecting sections 68 can resiliently twist or torsionally deflect during this process to allow latch 64 to ride over latch structure 84. Once engaging surface 88, the latch 64 then resides such that the surfaces 71, 88 prevent unintentional withdrawal or disconnection of the two connectors 14, 46 from each other.

Referring now to FIG. 3, the connector 14 is shown with the cover 30 moved to its rearward position. The cover 30 is moved by the user in order to disengage the latching engagement of the two latches 64, 84 which allows disconnection of the two connectors 14, 46 from each other. As the cover 30 is moved rearward, the cover 30 slides along the side walls 34 of the base 28. The substantially stationary section 62 does not move with the cover 30. However, the latch deflector 40 comes into contact with the ramp 77 as the cover 30 moves rearward. As the latch deflector 40 continues its rearward travel along the ramp 77 towards the elevated rear section 76, the deflection control section 66 is deflected or pushed inwardly as indicated by arrow A in FIG. 3. Because the latching section 60 is connected to the substantially stationary section 62 by the connecting sections 68, and because of the stiffener 74, the inward movement of the deflection control section 66 causes the connecting sections 68 to resiliently deflect. More specifically, the connecting sections 68 twist or torsionally deflect. Since connecting sections 68 rest on the top of the contact sub-assembly frame 48, the proper deflection of latch 64 is ensured. As the deflection control section 66 is deflected downwardly, and because of the resultant twisting of the connecting sections 68, the latching section 60 essentially pivots or rotates relative to the substantially stationary section 62 at the connecting sections 68. This rotation causes the latch 64, located at the front of the latching section 60, to be moved or rotated upward as indicated by arrow B. This upward movement of the latch 64 causes the hole 70 and its latch surface 71 to move above the latch 84. This prevents the two latch surfaces 71, 88 from engaging each other and allows the two connectors 14, 46 to be disconnected from each other. When the cover 30 is returned back to its forward position, the latch deflector 40 moves off the elevated section 76 and off the ramp 77, and the connecting sections 68 resiliently return to their straight shapes. This causes the latching section 60 to rotate in directions reverse to A and B to thereby return the latching section 60 to the position shown in FIG. 2. The connector 14 can, thus, be connected to the connector 46 again.

In an alternate embodiment the shield 26 could have only one connecting section 68 or more than two connecting sections. In another alternate embodiment the connector 14 could have a stationary cover with a push-button type of deflection control section. The present invention is an integrated electromagnetic shield and latch system, preferably for a miniaturized cable connector. The present invention provides an integration of a shielding function and a latching function at a significantly lower cost and higher potential reliability than a conventional design. The cable connector in one embodiment of this design concept has three or four basic components. The connector base is a "U"" shaped die cast metal or metallized plastic frame. This frame is the basic structural element of the connector body. The contact wafer or contact frame support is the second element. In the preferred case the contact wafer is a molded wafer with mating contacts on both sides of the wafer, with a front portion being mating contacts and the rear portion being contacts for metallurgical bonding conductors of the cable to the contacts. This mates with the connector frame and registered by means of grooves in the frame and a matching feature on the wafer. The third element is the shield/latch plate. This is preferably a stamped part. It has bent down side walls and a latch configuration blanked and formed into the top surface. This blanked and formed piece is then pressed into place in suitable grooves in the cable connector frame. Barbs or latches may secure it in place, and this shield member could also secure the contact wafer in the connector frame. The stamped and formed plate functions to complete the electromagnetic shield of the connector.

When the connector is mated with its corresponding receptacle, the shield contacts either a suitable conductive shield on the corresponding receptacle connector or a metallized surface of the receptacle. This maintains the continuity of the electromagnetic shield through the connector interface. Around the mid-line of the shield is the latching member. Again, when the cable connector is mated with the corresponding receptacle, this member deflects over a projection on the external surface of the receptacle and consequently latches the connector in place. It also provides a tactile indication that the connector is fully inserted as well as providing additional shielding contact between the two connector bodies. The latch can be disengaged in a number of ways. Minimally, there can be a member rearward of the latching member attached to the rest of the sheet metal by two beams capable of torsional deflection. As the latching member ride s up over the latch bump, these beams rotate. When rearward member is depressed downward the reverse process occurs where the latching member is elevated. In the preferred design this rearward member is depressed by a cam feature that is part of an external cover for the connector. In this case, in order to remove the connector from the system, the cover is grasped either by the side or by the top and bottom of the connector and pulled toward the cable portion of the connector. The cam on the interior or the sliding cover then depresses the rearward member and disengages the latch. The cover is then returned to the previous position by the return of the rearward member to its original position. Alternatively, a button-like arrangement can be molded into the cover and the disengagement can be accomplished by depressing the button.

In miniaturized systems this latching arrangement has particular functional advantages, since in small portable equipment it is difficult to design in enough space to make it easy to activate more conventional types of latching systems. In this case, only the larger exterior body of the connector, which is usually accessible, needs to be activated, which allows for denser packaging of the I/O connectors.

As described above, since base 28 is made from a conductive material, shield 26 need only reside generally above contacts 50. If, however, base 28 was made from an insulative material, then shield 26 should preferably surround contacts 50.

In summary, this design integrates the shielding, shield interconnection and latching function into a single component of the cable assembly, potentially reducing cost and improving reliability. This design allows the latch to be actuated in a number of ways including a sliding cover, which can minimize the packaging space required for the system.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing;

an electrical contact disposed in the housing; and a shield connected to the housing, the shield comprising a latching section, a deflection control section, and a first torsionally deflectable beam extending laterally from the latching section at a location between the latch and the deflection control section and connecting the latching section with the rest of the shield, wherein the shield is stamped and formed from a sheet of conductive material.

2. An electrical connector comprising:

a housing;

an electrical contact disposed in the housing; and a shield connected to the housing, the shield comprising a latching section, a deflection control section, and a first torsionally deflectable beam extending laterally from the latching section at a location between the latch and the deflection control section and connecting the latching section with the rest of the shield, wherein the shield comprises a second torsionally deflectable beam extending laterally from the latching section on an opposite side of the latching section from the first torsionally deflectable beam.

3. A connector as in claim 2 wherein the latch and the deflection control section extend from the two torsionally deflectable beams in generally cantilever fashion in reverse directions.

4. An electrical connector comprising:

a housing;

an electrical contact disposed in the housing; and a shield connected to the housing, the shield comprising a latching section, a deflection control section, and a first torsionally deflectable beam extending laterally from the latching section at a location between the latch and the deflection control section and connecting the latching section with the rest of the shield, wherein the latch and the deflection control section are connected to the rest of the shield by the first beam such that the latching section and the deflection control section are movable relative to each other in reverse unison with the first beam torsionally deflecting.

5. An electrical connector comprising:

a housing;

an electrical contact disposed in the housing; and a shield connected to the housing, the shield comprising a latching section, a deflection control section, and a first torsionally deflectable beam extending laterally from the latching section at a location between the latch and the deflection control section and connecting the latching section with the rest of the shield, wherein the housing comprises a base and a cover movably mounted to the base.

6. A connector as in claim 5 wherein the cover comprises an inwardly projecting latch deflector for contacting the deflection control section and moving the deflection control section in an inward direction.

7. A connector as in claim 5 wherein the cover is slidingly connected to the base between a first position and a second position.

8. An electrical connector comprising:

a housing, having a base;

an electrical contact disposed in the housing;

a shield connected to the housing, the shield comprising a latching section, a deflection control section, and a first torsionally deflectable beam extending laterally from the latching section at a location between the latch and the deflection control section and connecting the latching section with the rest of the shield; and a contact sub-assembly connected to the base, the contact sub-assembly comprising an insert made from a dielectric material and the electrical contact mounted to the insert.

9. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the shield is stamped and formed from a conductive sheet, and the latch is integrally formed with the deflection control section.

10. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the shield comprises a first laterally extending torsionally twistable beam extending from an area between the latch and the deflection control section.

11. An electrical connector as in claim 10 wherein the shield further comprises a second laterally extending torsionally twistable beam extending from the area between the latch and the deflection control section in an opposite direction relative to the first beam.

12. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the latch and the deflection control section extend from each other in opposite directions in general cantilever fashion.

13. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the latch deflector comprises a protrusion on an underside surface of the cover.

14. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the cover comprises a general cross-sectional "U" shape.

15. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the shield comprises a general "U" shaped profile.

16. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the cover is slidingly connected to the base between a forward position and a rearward position.

17. An electrical connector comprising:

a housing comprising a base and a cover movably connected to the base, the cover comprising a latch deflector;

at least one electrical contact disposed in the housing; and a shield connected to the housing, the shield comprising a latch and a deflection control section, the deflection control section adjacent the latch deflector, and the latch and latch deflector being movable in reverse unison, wherein the latch deflector is movable to engage the deflection control section which actuates the latch, and wherein the connector is part of a cable assembly.

18. A method of manufacturing an electrical connector comprising steps of:

connecting an electromagnetic shield to a housing of the connector the housing having a base, the shield comprising an integral latch and an integral latch deflection control; and connecting a cover to the base over the shield, the cover comprising a latch deflector located adjacent the latch deflection control, wherein the cover is movable relative to the base between a first position and a second position, wherein, when the cover is moved from the first position to the second position, the latch deflector moves the latch deflection control in a direction causing the latch to deflect in a generally opposite direction, and wherein the step of connecting the cover comprises the cover being slidingly connected to the base between a forward position and a rearward position.

* * * * *